US006126578A

United States Patent [19]

Lapointe

[11] Patent Number: 6,126,578

[45] Date of Patent: Oct. 3, 2000

[54] JUMPING DEVICE HAVING A FLEXIBLE TETHER AND METHOD OF USING THE JUMPING DEVICE

[76] Inventor: Brian Lapointe, 53 Jerdens La., Rockport, Mass. 01966

[21] Appl. No.: 09/002,550

[22] Filed: Jan. 2, 1998

[51] Int. Cl.[7] ..... A63B 25/08

[52] U.S. Cl. ..... 482/77; 472/135

[58] Field of Search ..... 482/26, 27, 51, 482/74, 75, 77, 79, 128, 146, 81; 472/14, 25, 135; 446/486; 280/1.191

[56] References Cited

U.S. PATENT DOCUMENTS

| | | | |
|---|---|---|---|
| D. 361,604 | 8/1995 | Stroppiana . | |
| D. 370,958 | 6/1996 | Rash . | |
| 2,242,748 | 5/1941 | Fulwiler | 482/77 |
| 2,961,235 | 11/1960 | Blanchard . | |
| 3,298,686 | 1/1967 | Hansburg . | |
| 3,427,019 | 2/1969 | Brown | 482/77 |
| 3,614,084 | 10/1971 | Brown . | |
| 3,627,314 | 12/1971 | Brown . | |
| 4,323,231 | 4/1982 | Wilson | 482/51 |
| 4,774,776 | 10/1988 | Gulli . | |
| 4,876,804 | 10/1989 | Hart . | |
| 5,230,947 | 7/1993 | Ou | 428/212 |
| 5,391,134 | 2/1995 | Heatwole | 482/75 |
| 5,569,131 | 10/1996 | Giulianelli | 482/77 |
| 5,656,000 | 8/1997 | Russell | 482/74 |
| 5,795,277 | 8/1998 | Bruntmyer | 482/77 |

FOREIGN PATENT DOCUMENTS

| | | | |
|---|---|---|---|
| 2435094 | 12/1976 | Germany | 482/77 |
| 680572 | 9/1992 | Switzerland | 482/121 |
| 659280 | 10/1951 | United Kingdom | 472/135 |

OTHER PUBLICATIONS

The Good Kids Catalog Co., Defy Gravity! Moon Shoes are Trampolines for Your Feet.
Color copy of Aviva Sports "Boingo" device.
The Good Kids Catalog Co., Hoppity Hops.
The Good Kids Catalog Co., Pogo Ball.
The Good Kids Catalog Co., Pogo Roo™.
The Good Kids Catalog Co., Plastic Hi–Steppers.
The Good Kids Catalog Co., Buddy Walkers™.
The Good Kids Catalog Co., Gym Skis™.

*Primary Examiner*—Richard J. Apley
*Assistant Examiner*—Victor Hwang
*Attorney, Agent, or Firm*—Faegre & Benson, LLP.

[57] ABSTRACT

A jumping device having a high rebound platform, a flexible tether operatively connected at a first end thereof to the high rebound platform, and a handle located on the tether. A method of jumping, including providing a jumping device having a high rebound platform, a flexible tether operatively connected at a first end thereof to the high rebound platform, and a handle on the tether, mounting the jumping device by placing a user's foot on the high rebound platform, grabbing the handle, pulling the handle away from the high rebound platform, and jumping so that the high rebound platform alternates between compressed and uncompressed states.

11 Claims, 5 Drawing Sheets

JUMPING DEVICE HAVING A FLEXIBLE TETHER AND METHOD OF USING THE JUMPING DEVICE

BACKGROUND OF THE INVENTION

1. Field of the Invention

This invention is in the field of jumping devices for the purposes of amusement and exercise. More specifically, this invention relates to a jumping device of the type including interaction with a user's hands and feet and having a high rebound platform and a flexible tether that can be grasped by a user. By such a device, a user can bounce indefinitely on the high rebound platform while maintaining the platform against the user's feet by way of the flexible tether.

2. Description of the Related Art

Jumping devices for amusement and exercise are well known. Perhaps the most common jumping device is the pogo stick. Conventional pogo sticks typically have a telescoping design that includes a tubular frame from which a spring-actuated plunger member extends downward and terminates in a tip that contacts the ground during use of the pogo stick. Transverse footrests are formed near the lower end of the frame to allow a user of the pogo stick to mount the pogo stick and compress a spring of the plunger by applying a downward force. A typical pogo stick is disclosed in U.S. Pat. No. 2,712,443, issued to H. H. Hohberger.

Conventional pogo sticks have several limitations. Conventional pogo sticks require several moving parts that increase manufacturing costs and reduce durability. Also, the use of a spring that is compressed by the telescoping action of the frame and the plunger member requires that the frame and the plunger member be rigid enough to transmit compressive force to the spring. The use of typical rigid materials (e.g., a rigid metal such as steel) increases the risk of injury to the user of the pogo stick if the user should fall and be struck with the pogo stick. In addition, the rigid materials cause conventional pogo sticks to generate significant noise during operation which makes conventional pogo sticks less amenable to quiet indoor use.

Moreover, conventional pogo sticks are typically designed with plunger member tips and footrests that have small surface areas relative to the surface area of the user's feet. This makes conventional pogo sticks unstable during mounting and operation of the pogo stick and requires that users have a fairly high degree of balancing skills in order to operate the pogo stick. Furthermore, the unstable nature of conventional pogo sticks limits the range of maneuvers that can be performed on conventional pogo sticks and makes conventional pogo sticks difficult to abandon during a fall.

Other less complicated devices have been developed having other spring means instead of such noisy mechanical springs. For example, in U.S. Pat. No. 3,627,314, issued to Brown, a pogo stick is described utilizing an inflatable ball having a platform surface and mounted to a stick handle. Although such a device eliminates some disadvantages, it is still relatively unstable, requires a fairly high degree of balance to operate and has limited maneuverability.

SUMMARY OF THE INVENTION

The present invention provides an improved jumping device that has minimal moving and rigid parts and a wide, stable jumping platform that provides more balancing time before jumping and allows a user to safely and quietly perform a range of jumping maneuvers. Also, folding the flexible tether facilitates convenient storage of the jumping device.

In one aspect, the present invention relates to a jumping device having a high rebound platform, a flexible tether attached to the platform, and a handle located on the tether.

In another aspect, the present invention relates to a method of jumping, including the step of providing a jumping device having a high rebound platform, a flexible tether attached at a first end to the platform, and a handle on the tether, the step of mounting the jumping device by placing a user's foot (or both feet) on the platform, grabbing the handle, then pulling the handle away from the platform, and jumping so that the platform alternates between compressed and uncompressed states.

DETAILED DESCRIPTION OF THE PREFERRED EMBODIMENTS

Figure 1:
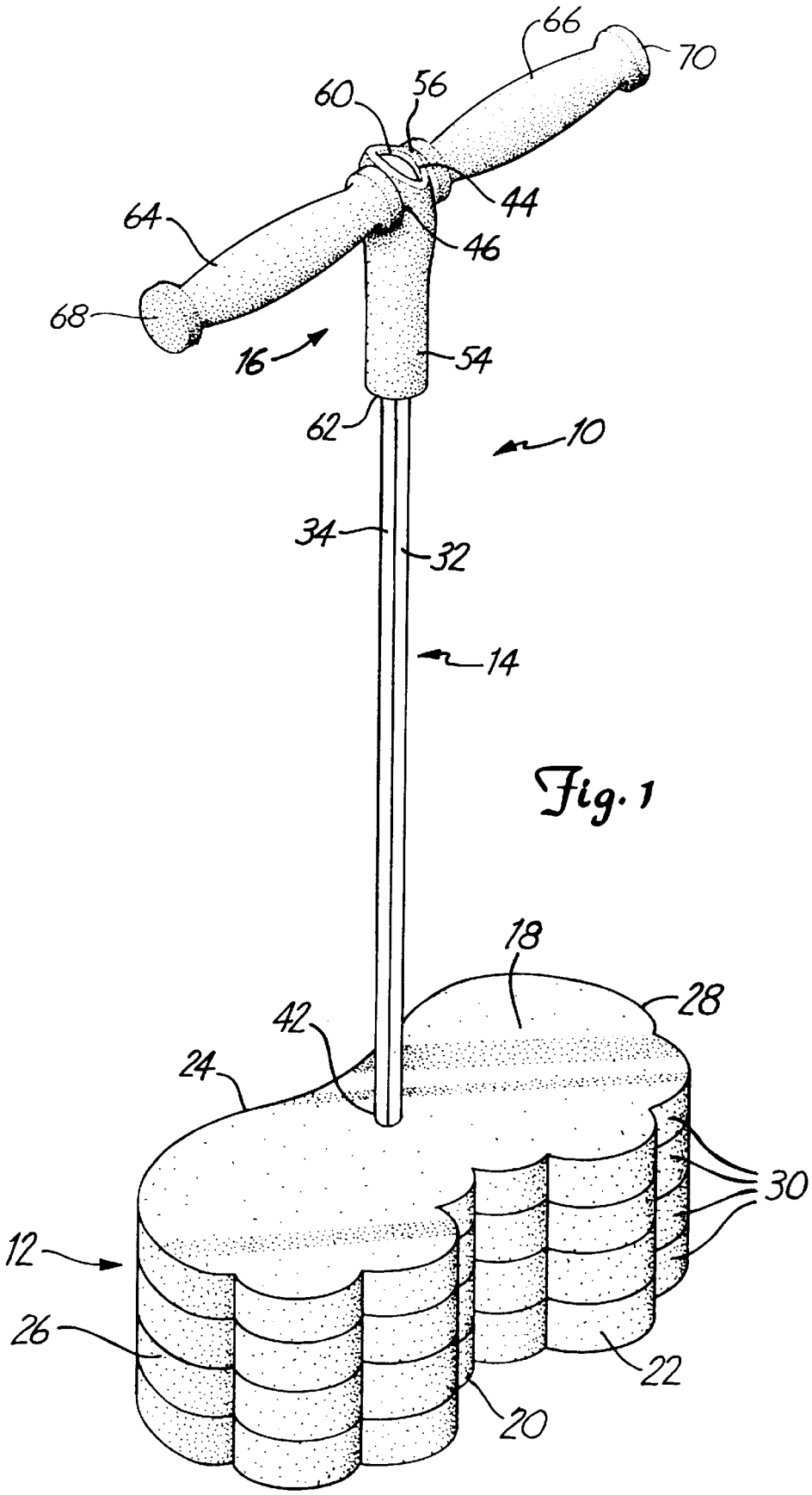
FIG. 1 is a perspective view of a jumping device according to the present invention.
Figure 2:
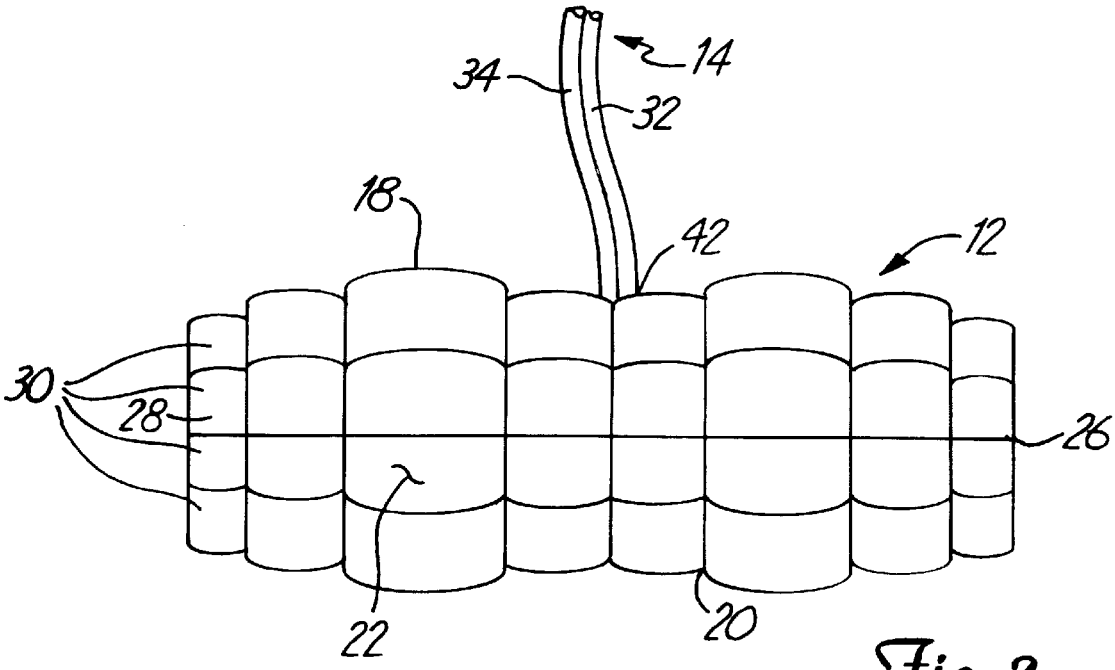
FIG. 2 is a front view of a platform and a lower portion of a tether of the jumping device shown in FIG. 1.
Figure 3:
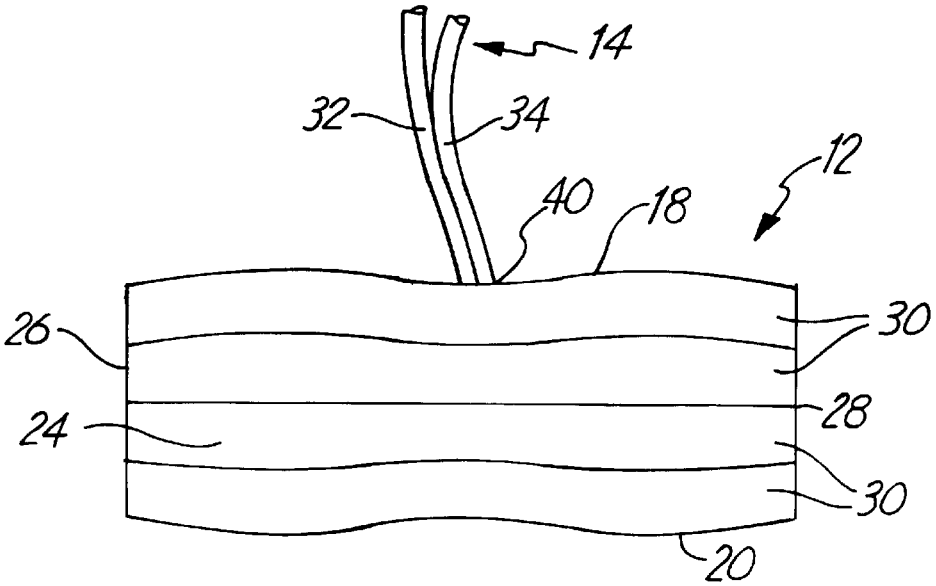
FIG. 3 is a rear view of the platform and a lower portion of the tether of the jumping device shown in FIG. 1

FIGS. 1–5 show a jumping device 10 in accordance with a first embodiment of the present invention. Device 10 includes a high rebound platform 12, a tether 14 attached to the platform 12, and a handle 16 provided at an end of the tether 14.

High rebound platform 12 is formed so that platform 12 can be made to alternate between a compressed state and an uncompressed state. Generally, when a body elastically compresses due to the application of compressive forces, potential energy is stored in the deformed body. The transition of the body from a compressed state to an uncompressed state results in the conversion of potential energy to kinetic energy. A high rebound platform 12 in accordance with the present invention is a structure that can be made to elastically compress between a user's feet (which contact a foot support surface 18 located on the top of platform 12) and the ground or other rigid surface (which contacts an impact surface 20 located on the bottom of platform 12) by having at least a portion of the foot support surface 18 and at least a portion of impact surface 20 move closer to one another so that kinetic energy provided during the transition of the structure from a compressed state to an uncompressed state is sufficient to create a rebound force that assists the user in jumping. A high rebound platform 12 can be characterized by the basic ability to support a user to permit jumping without bottoming out and to provide some amount of energy to assist the user in jumping. It is envisioned that jumping device 10 can be designed to operate for a particular range of user weights. Therefore, high rebound platform 12 may be adapted to elastically compress and provide rebound force for the particular range of user weights for which the device 10 is designed. It is also envisioned that a product feature, shape of a component, color code, or other labeling scheme could be used to convey easily the range of user weights appropriate for a particular jumping device 10.

High rebound platform 12 is preferably formed from any one of a number of conventional solid, closed cell, or open cell materials that are commonly used to absorb impact or provide rebound. More specifically, platform 12 can be formed from rubbers including but not limited to natural foam rubber, natural butyl rubber (NBR), natural rubber (NR), thermoplastic rubber (TPR), and plastics including but not limited to polyethylene (PE), polyurethane (PU), and ethyl vinyl acetate (EVA). Generally, for a given high rebound material having a given contact surface area, the thicker (measured from foot support surface 18 to impact surface 20 of platform 12) platform 12 is, the greater the range of user weights over which the platform 12 will elasticly compress and provide a rebound force. It is also understood that with different high rebound materials and different contact surface areas various weight ranges can be accommodated.

FIGS. 1–4 show platform 12 formed from a plurality of layers 30, wherein the layers are attached to one another using conventional adhesives. Other conventional lamination techniques can be used instead. Preferred high rebound materials includes but are not limited to Zoatfoam EV-50 EVA foam from Zoatfoam Inc. of Hacketstown. N.J.; foam model MC3800S with EVA from Sentinal Co.; foam model 5A with EVA from Voltek, and foam product commercially available under the tradename Metalocene from E.I. Dupont de Nemours and Co., Wilmington, Del. As shown, each layer is preferably shaped so that when stacked, the layers 30 form a complete, shaped platform 12. The layers 30 can be shaped by use of conventional die-cut techniques, for example. The layers 30 may be shaped for functional or aesthetic reasons, and each layer may be the same or different as the others. The top and bottom layers, in particular, may also be shaped in the thickness direction so as to provide any desired surface features. For example, the foot support surface 18 or the impact surface 20 may be rounded, or may be patterned to enhance gripping of the surface(s) with a user's foot (or feet) or the floor. Such a pattern may be for anti-slip properties, or to permit use on wet surfaces or other materials (e.g., grass lawns, concrete, etc.) that may otherwise affect the material (e.g., by abrasion or puncture). Moreover, each of the layers 30 may be made of the same or different material. For example, the bottom layer may be of a tougher material to enhance its durability for particular surfaces like concrete. For use in homes, a softer (non-scratch) material may be desirable. Along these same lines, coatings or other surface treatments are also contemplated. Surface treatments include the provision of sheet material to cover all or a portion of the impact surface 20, for example. A non-slip material may be desirable for rendering the device more suitable for use on certain surface such as finished wood.

Alternatively, platform 12 can be formed as a single piece of rebound material. Like the laminated platform described above, a single block platform 12 can be shaped, coated or treated to have certain properties or for aesthetic reasons depending on an intended usage of the device 10. Moreover, even with a single layer construction, more than one distinct material portions thereof can be made by conventional techniques used in the making of the material, e.g., using coextrusion techniques. It is believed that for conventional rubbers and plastics, high rebound platform 12, whether formed from single or multiple layers, should have a thickness in the range of about 1 inch to about 12 inches and preferably has a thickness of about 4.5 inches for an average user.

Figure 6:
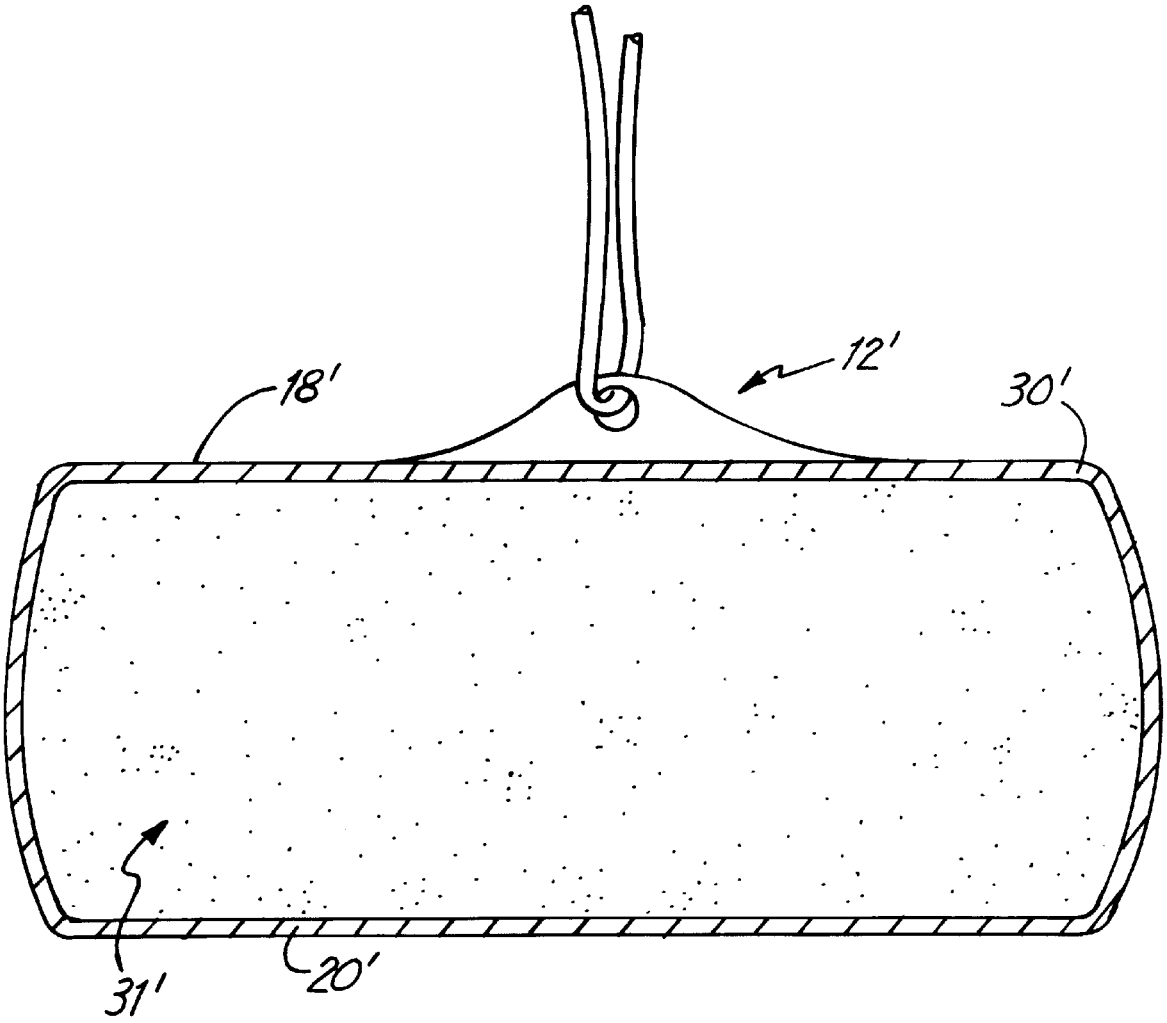
FIG. 6 is a side view of an alternative high rebound platform formed as a bladder structure.

Alternatively, as shown in FIG. 6, a high rebound platform 12' may be constructed from materials without relying on a rebound characteristic of the material itself, as is the case with a foam layer or foam layers. A resilient material may be shaped to form a bladder 30' (that may be similar to or different from the layered platform 12 of FIG. 1) and filled with a fluid 31'. Then, bladder 30' can be compressed between a user's feet (which contact a foot support surface 18' located on the top of platform 12') and the ground or other rigid surface (which contacts an impact surface 20' located on the bottom of platform 12') so that the fluid 31' (such as air) is compressed or bladder 30' is caused to expand, or both, to store potential energy and so that kinetic energy provided during the transition of the structure from a compressed state to an uncompressed state is sufficient to create a rebound force that assists the user in jumping.

Again referring to FIGS. 1–5, foot support surface 18 and impact surface 20 of platform 12 are advantageously shaped to allow a user of the device 10 more easily to maintain balance while operating the device 10. It is believed that platform 12 should have a depth (measured from a front face 22 to a back face 24 of platform 12) of at least about 2 inches and preferably has a depth in the range of about 4 inches to about 8 inches for an average user. It is also believed that platform 12 should have a width (measured from a first lateral side 26 to a second lateral side 28) of at least about 6 inches and preferably has a width of about 12 inches for an average user. In FIGS. 1–4, foot support surface 18 and impact surface 20 have the same shape, though, as above, foot support surface 18 and impact surface 20 could have shapes that differ from one another.

Figure 4:
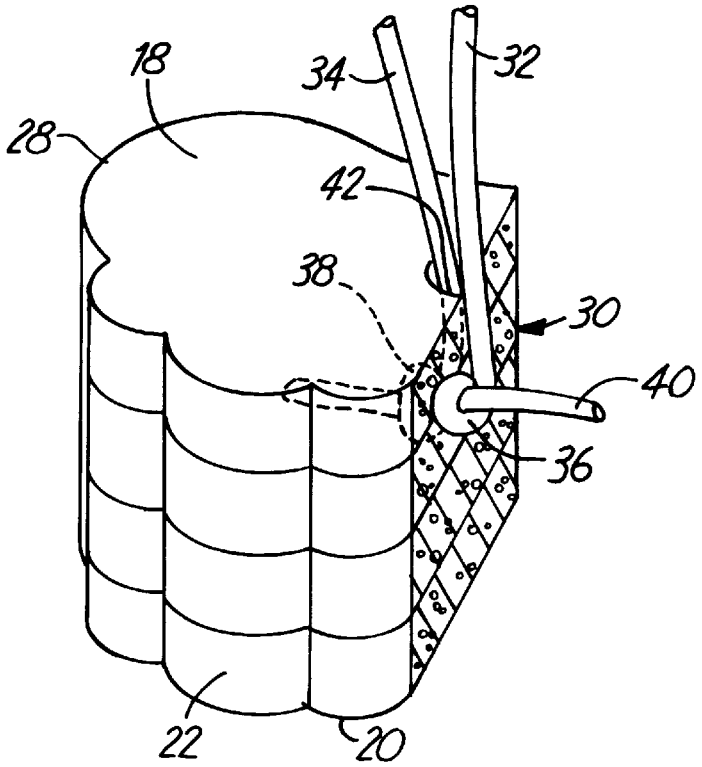
FIG. 4 is a fragmentary view of the platform and a lower port on of the tether of the jumping device shown in FIG. 1 with a portion of the platform removed so as to show a rod for fastening the tether to the platform.

FIGS. 1–5 show a tether 14 formed preferably as a loop of flexible (i.e., non-rigid) cord having two straightenable portions 32 and 34 that are attached to the platform 12. As shown in FIG. 4, ends 36 and 38 of portions 32 and 34, respectively, can be connected to a rigid rod 40 (preferably formed from bamboo because it is rigid and lightweight) that is located within the layers 30 of platform 12. The ends 36 and 38 may be formed as loops that surround and connect to rod 40. An opening 42 can be formed in one or more of the layers of platform 12 so as to allow portions 32 and 34 of tether 14 to pass through foot support surface 18 of platform 12 and attach to rod 40. Other ways of connecting the tether portions 32 and 34 to the platform 12 are also contemplated. For example, the portions 32 and 34 can be passed through opening(s) of platform 12 all the way though and be tied to together at the impact surface 20 in which recesses can be formed to accommodate the tied portions 32 and 34 so as to provide a substantially flat, stable impact surface 20. Likewise, the rod 40 may be provided at any location within the thickness of the platform 12 (e.g., between any two layers 30) and may be of any effective shape (e.g., a plate-like element to which ends 36 and 38 are attached). Also, recesses may be formed in the layers 30 so as to accommodate the rod 40 and provide substantially flat foot support and impact surfaces 18 and 20.

Tether 14 is preferably significantly extendible and formed from an elastic material such as a textile-covered elastic cord or an extruded elastic tubing without a cover. Suitable tubing includes natural latex rubber tubing, commonly known as surgical tubing, because it is highly extendible. Alternatively, tether 14 can be formed from conventional non-elastic ropes, although an elastic tether 14 is preferred because an elastic tether 14 accommodates a wider range of user heights (by stretching to fit each user) and more securely holds the platform 12 against the user's feet during use due to the additional tension created by stretching the elastic tether 14. An extendible tether 14 may alternatively comprise one or portions of non-extendible materials combined with an extendible portion which may comprise stretchable cord as above or an extension spring.

Figure 5:
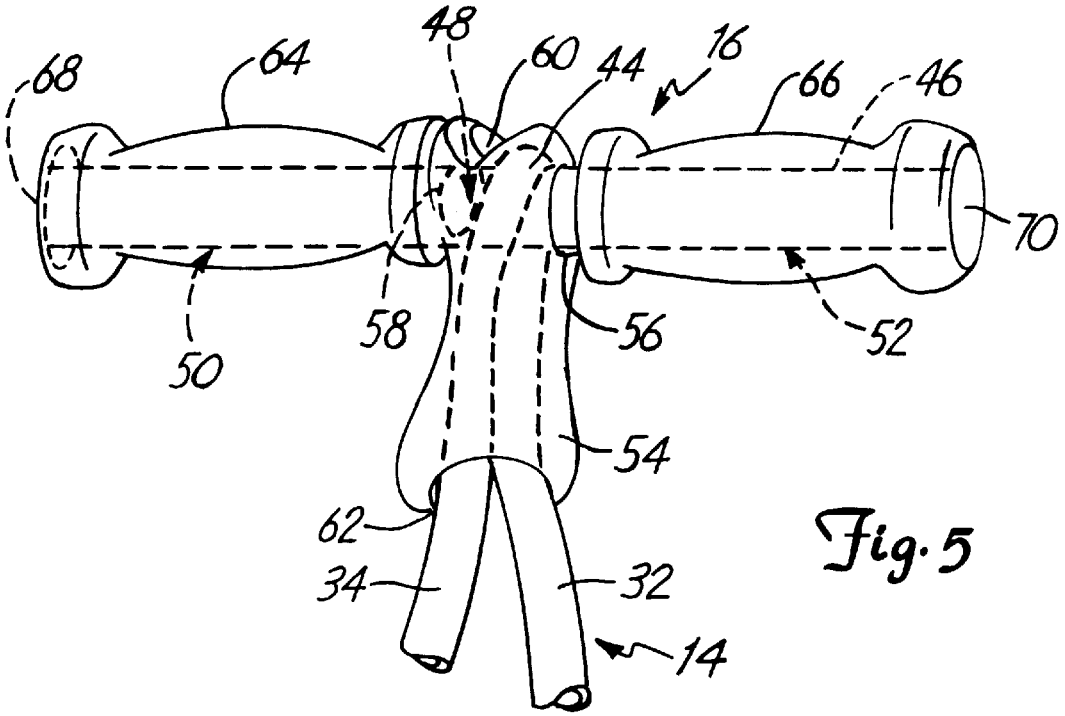
FIG. 5 is a perspective view of a handle and an upper portion of the tether of the jumping device shown in FIG. 1.

Handle 16 is formed on the tether 14 so as to provide the user of device 10 with a convenient place to grab and pull tether 14 away from platform 12. In the embodiment shown in FIGS. 1–5, handle 16 is a T-shaped assembly attached to a loop end 44 of tether 14. Handle 16, perhaps shown best in FIG. 5, has a transverse rod 46 around which tether 14 is looped generally in a center portion 48 of rod 46 so as to define two gripping portions 50 and 52 of rod 46 on either side of center portion 48. A foam sheath 54 surrounds a portion of tether 14 near the loop end 44. Sheath 54 has opposing lateral openings 56 and 58 to allow rod 46 to pass through sheath 54. Sheath 54 also has opposing longitudinal openings 60 and 62 that allow the ends 36 and 38 of the tether 14 to be threaded around rod 46 during assembly so that the loop end 44 of tether 14 can be looped around rod 46. Gripping portions 50 and 52 are preferably covered with shaped foam tubing so as to form foam grips 64 and 66, respectively, which provide the user of device 10 with padded gripping surfaces and prevent the loop end 44 of tether 14 and sheath 54 from sliding along the rod 46 during use of the device 10. Preferably, lateral ends 68 and 70 of rod 46 have cross sectional areas that are greater than the cross sectional area of the interior portions of the rod 46 so as to prevent grips 64 and 66 from sliding off the rod 46. As shown in FIG. 5, lateral ends 68 and 70 are formed integrally with rod 46, although lateral ends 68 and 70 can be formed as separate pieces (e.g., as rimmed end caps) that are attached to rod 46. Alternatively, the tether portions 32 and 34 may be directly tied on to the rod 46, or otherwise connected by way of a mechanical faster or adhesive, or the like.

In operation, a user mounts the device 10 by placing the user's feet on the foot support surface 18 of platform 12 on either side of opening 42, grabs the handle 16 with both of the user's hands, pulls the handle 16 away from platform 12 so as to tension tether 14, and jumps upward. As the user's legs extend during jumping, tether 14 keeps the device 10 under the user's feet, which preferably is further facilitated by the use of an elastic tether 14 which is stretched to provide additional tension. Upon impact, the user's knees bend to help absorb impact and prepare for another extension. Also, upon impact a generally downward, compressive force is applied to foot support surface 18 of platform 12 causing platform 12 to be compressed between the user's feet and the ground (or other rigid surface) as foot support surface 18 moves closer to impact surface 20 so that potential energy is stored in platform 12. The user extends the user's legs so as to propel the user and the device 10 upward which causes platform 12 to transition from a compressed state to an uncompressed state so as to release the stored potential energy as kinetic energy that creates a rebound force to assist the user in jumping. This motion can be done repeatedly for an indefinite length of time, as each subsequent jump utilizes the same compression of platform 12 to provide a rebound-assisted jump. The user can execute a wide range of maneuvers on device 10, for example, by maneuvering the user's body as is done to perform maneuvers on conventional skateboards, snow boards, or downhill skis.

Figure 7:
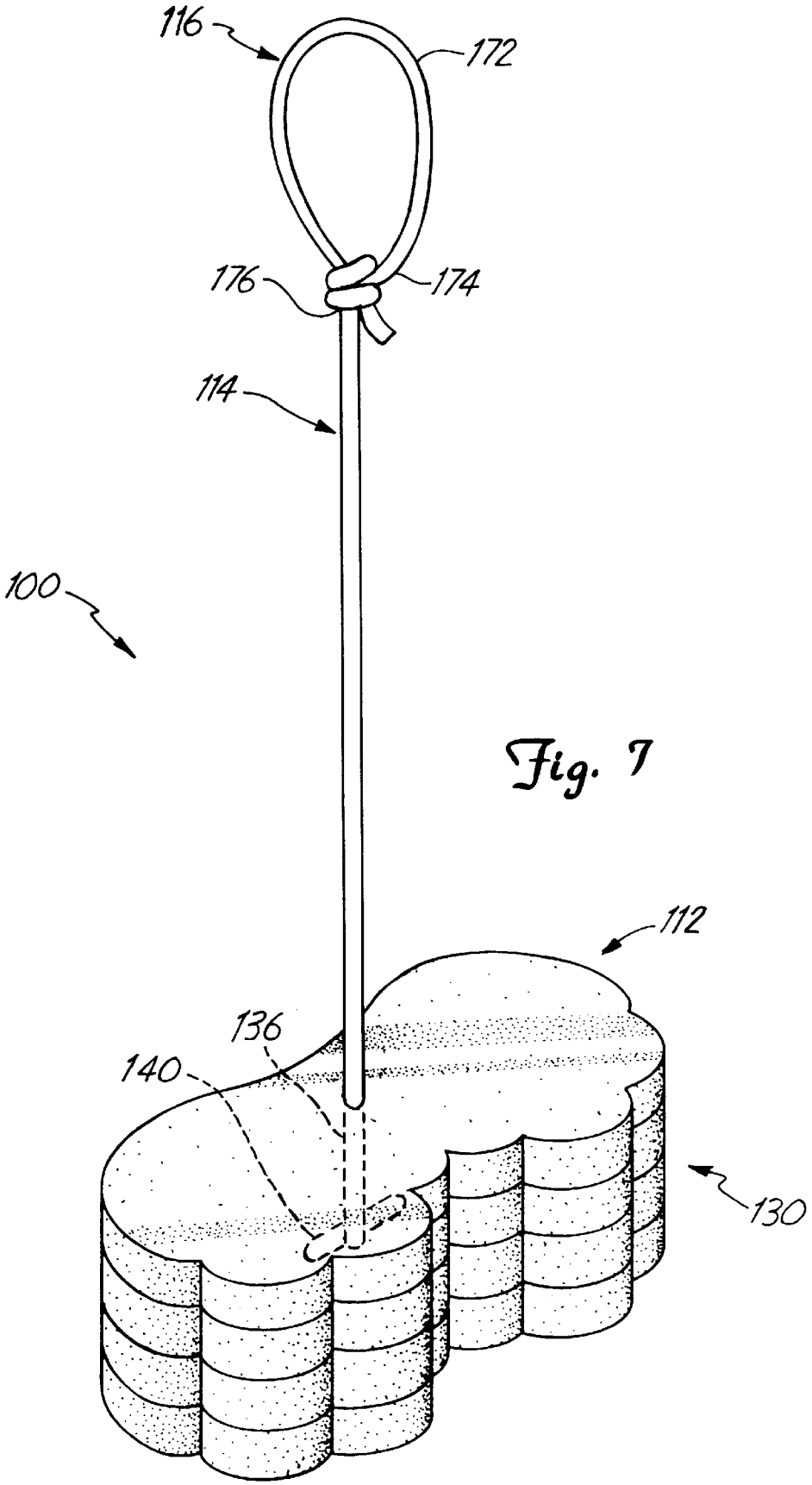
FIG. 7 is a perspective view of a jumping device according to a second embodiment of the present invention.

FIG. 7 shows a second embodiment of a jumping device 100 according to the present invention having a handle 116 formed integrally with a tether 114. Device 100 has a high rebound platform 112 that is preferably similar to platform 12 and is fabricated from similar materials in a similar manner. Tether 114 is similar to tether 14, is fabricated from similar materials in a similar manner, and is attached to platform 112 in the same way that tether 14 is attached to platform 12 except that tether 114 has only one end 136 that is tied to a rod 140 (similar to rod 40) located within the plurality of layers 130 of platform 112. A handle 116 is formed as a loop 172 by tying or otherwise attaching an end 174 of tether 114 to an intermediate portion 176 of tether 114. Preferably, end 174 is slidably attached to portion 176 so that the user of device 100 can alter the size of loop 172 by sliding end 174 along portion 176. This can be done by a sliding knot (as shown) or by way of a conventional sliding/clamping device to which an end of tether 114 can be tied. Device 100 can be used in the same manner as device 10.

As with any of the above specifically disclosed or suggested embodiments, the tether 14 (or 114) may comprise a single cord or may include any number cf cords, so long as there is a connection to a high rebound platform 12 (or 112), and some means is provided to facilitate grasping by a user. A jumping device that interacts with a user's feet and hands is thus provided. Other handle constructions are also contemplated and may be secured in any matter to the tether 14 (or 114).

As yet another specifically contemplated embodiment plural high rebound platforms can be used in combination with independent tethers. That is, two separate platforms may be provided, each having its own tether or tethers. Then, each tether may be combined together to form a handle or be connected to a separately provided handle. Each platform would preferably be connected to a tether or tethers in a way to permit independent leg movement. This may be facilitated by other fastening structures attached between the tether and the tether's platform, or by running plural tethers (or a loop from one tether) through the platform to extend on both sides of a user's foot to keep the platform oriented properly during use.

As still yet another specifically contemplated embodiment of a jumping device according to the present invention, a high rebound platform can comprise a foot support surface that is suspended from a rigid, trampoline-like frame. The foot support surface can be suspended from the frame by coil springs, stretchable cords, or other conventional tension springs devices. In this case, an impact surface is created by a portion of the frame that comes into contact with the ground or other rigid surface during use of the device. A flexible tether is attached to the high rebound platform, preferably in a position to be in between a user's feet, and a handle is formed on the tether to facilitate gripping by a user so as to provide the interaction between at least a hand and a foot of the user. The high rebound platform of this embodiment achieves a compressed state when the platform is compressed by the user's feet such that the foot support surface and/or the springs that attach the foot support surface to the frame, if any, are stretched and store potential energy in the deformed foot support surface and/or springs. When the high rebound platform transitions to the uncompressed state, the foot support surface and/or springs, if any, convert the potential energy to kinetic energy to provide a rebound force to assist the user in jumping. This embodiment is less advantageous for many uses, however, in that it requires more rigid parts and the platform is substantially compressible from only one surface (i.e., from the foot support surface).

Although the present invention has been described with reference to preferred embodiments, those skilled in the art will recognize that changes made be made in form and detail without departing from the spirit and scope of the invention.

What is claimed is:

1. A jumping device by which a user can jump on the ground repeatedly by interaction between at least a hand and a foot of the user, the jumping device comprising:

a high rebound platform comprising a foam material, the high rebound platform formed to provide a foot support surface on which a user can directly place a foot and an impact surface for engaging and moving away from the ground during jumping, said high rebound platform being able to assume a compressed state from an uncompressed state when a compressive force is applied to the high rebound platform, in said compressed state said foot support surface is positioned closer to said impact surface without significant plastic deformation of the high rebound platform, so that when a compressive force is applied to said high rebound platform said high rebound platform is changed from its uncompressed state to its compressed state with energy absorbed thereby and which energy is utilized to assist a user in jumping as the high rebound platform changes back to its uncompressed state from its compressed state;

said foam material comprises a plurality of substantially planar layers of foam laminated to one another, said impact surface being a generally flat surface;

a flexible tether operatively connected at a first end thereof to the high rebound platform so that the tether is movable with the high rebound platform during jumping; and a handle located on the tether.

2. The jumping device of claim 1, wherein the high rebound platform comprises an open-cell foam material.

3. The jumping device of claim 1, wherein the high rebound platform comprises a closed cell foam material.

4. The jumping device of claim 1, wherein the tether is substantially inelastic.

5. The jumping device of claim 1, wherein the handle is formed separately from tether.

6. The jumping device of claim 5, wherein the handle is a T-shaped handle attached to a second end of the tether.

7. The jumping device of claim 1, wherein the handle is formed integrally with the tether.

8. The jumping device of claim 7, where in the handle is a loop formed at a second end of the tether.

9. A method of jumping on a jumping device by a user by interaction between at least a hand and a foot of the user, said method comprising the steps of:

providing a jumping device having a high rebound platform comprising a foam material, the high rebound platform formed to provide a foot support surface on which a user can directly place a foot and an impact surface for engaging the ground during jumping, said high rebound platform being able to assume a compressed state from an uncompressed state when a compressive force is applied to the high rebound platform, in said compressed state said foot support surface is positioned closer to said impact surface without significant plastic deformation of the high rebound platform, so that when a compressive force is applied to said high rebound platform said high rebound platform is changed from its uncompressed state to its compressed state with energy absorbed thereby and which energy is utilized to assist a user in jumping as the high rebound platform changes back to its uncompressed state from its compressed state, a flexible tether operatively connected at a first end thereof to the high rebound platform, and a handle on the tether;

said foam material comprises a plurality of substantially planar layers of foam laminated to one another, said impact surface being a generally flat surface;

mounting the jumping device by placing a user's foot on the foot support surface of the high rebound platform;

grabbing the handle;

pulling the handle away from the high rebound platform after the grabbing step; and jumping so that the high rebound platform alternates between its compressed and uncompressed states while holding onto the handle.

10. The method of claim 9, wherein the mounting step comprises placing both of a user's feet on a foot support surface of the high rebound platform with the flexible tether between the user's feet.

11. A jumping device by which a user can jump on the ground repeatedly by interaction between at least a hand and a foot of the user, the jumping device comprising:

a high rebound platform comprising a foam material, the high rebound platform formed to provide plural foot support surface portions on each of which a user can directly place a foot and an impact surface for engaging and moving away from the ground during jumping, said high rebound platform being able to assume a compressed state from an uncompressed state when a compressive force is applied to the high rebound platform, in said compressed state a foot support surface portion is positioned closer to said impact surface without significant plastic deformation of the high rebound platform, so that when a compressive force is applied to said high rebound platform said high rebound platform is changed from its uncompressed state to its compressed state with energy absorbed thereby and which energy is utilized to assist a user in jumping as the high rebound platform changes back to its uncompressed state from its compressed state;

said foam material comprises a plurality of substantially planar layers of foam laminated to one another, said impact surface being a generally flat surface;

a flexible tether operatively connected at a first end thereof to the high rebound platform so as to extend from the high rebound platform between foot support surface portions and so that the tether is movable with the high rebound platform during jumping; and a handle located on the tether.

* * * * *